US005129374A

United States Patent [19]

Flavio

[11] Patent Number: 5,129,374

[45] Date of Patent: Jul. 14, 1992

[54] HYDRAULIC TAPPET

[75] Inventor: Rigamonti Flavio, Turin, Italy

[73] Assignee: Eaton Corporation, Cleveland, Ohio

[21] Appl. No.: 773,552

[22] PCT Filed: May 15, 1990

[86] PCT No.: PCT/US90/02706

§ 371 Date: Nov. 13, 1991

§ 102(e) Date: Nov. 13, 1991

[87] PCT Pub. No.: WO90/15226

PCT Pub. Date: Dec. 13, 1990

[30] Foreign Application Priority Data

May 23, 1989 [IT] Italy ..... 20601 A/89

[51] Int. Cl.[5] ..... F01L 1/24

[52] U.S. Cl. ..... 123/90.55; 123/90.52; 74/569

[58] Field of Search ..... 123/90.48, 90.49, 90.52, 123/90.55, 90.56, 90.57, 90.59; 74/569

[56] References Cited

U.S. PATENT DOCUMENTS 4,579,094 4/1986 Doppling et al. ..... 123/90.55
4,721,076 1/1988 Goppelt et al. ..... 123/90.55
4,745,889 5/1988 Speil ..... 123/90.55
4,782,799 11/1988 Goppelt et al. ..... 123/90.55
4,867,114 9/1989 Schaeffler ..... 123/90.55

*Primary Examiner*—E. Rollins Cross
*Assistant Examiner*—Lo Weilun
*Attorney, Agent, or Firm*—F. M. Sajovec

[57] ABSTRACT

A hydraulic tappet is provided with an outer reservoir extending for 360° on two levels, thus causing air bubbles in the oil supplied thereto to remain on the upper level of the outer reservoir. According to a first embodiment of the invention the circulation of the oil on two levels is provided by means of a first insert made of plastic, the support for the lash adjusting components is provided and by a second insert made of metal sheet, the second insert including a web portion which also serves as a boundary for the lower level reservoir. According to another embodiment of the invention, the support for the lash adjusting components is provided by a hub structure extending axially from the tappet body, and a single plastic insert is provided to define, along with the exterior of the hub portion, the two-level reservoir.

5 Claims, 1 Drawing Sheet

HYDRAULIC TAPPET

Figure 1:
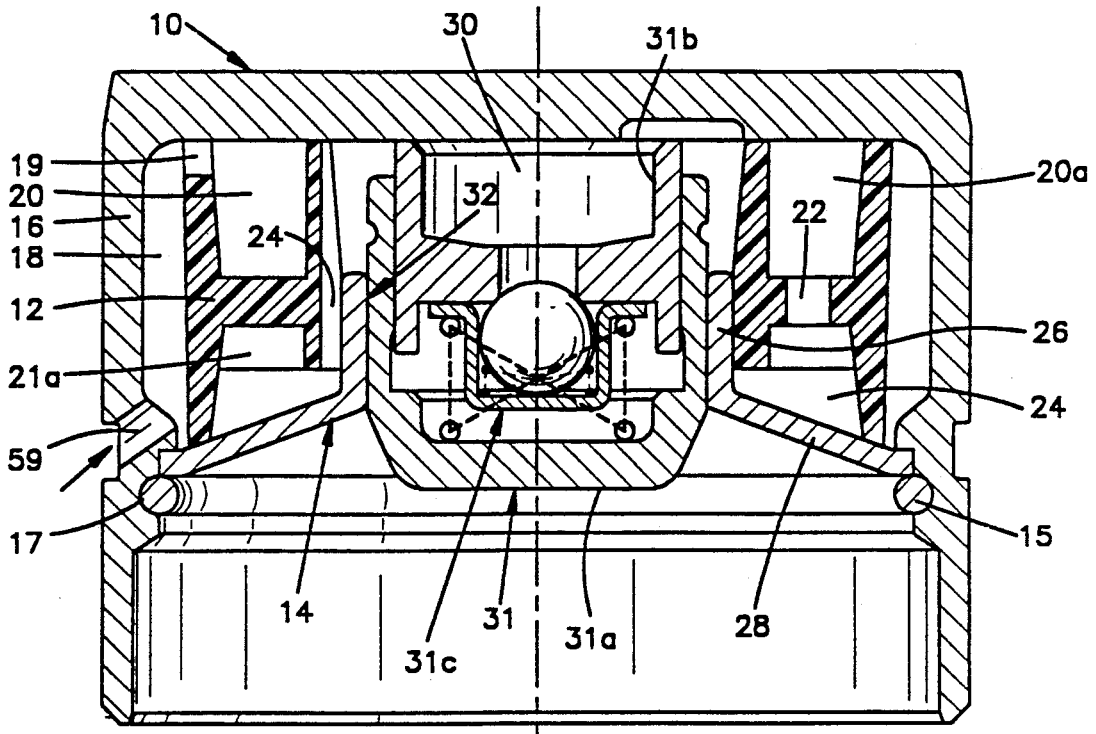

The present invention relates to hydraulic tappets for internal combustion engines, and more specifically to hydraulic tappets of the direct acting bucket type.

In the design of bucket tappets having an outer reservoir and an inner reservoir as exemplified by the tappets shown in U.S. Pat. No. 4,590,898 to Buente et al., it is important to prevent air bubbles present in the oil coming from the lubrication circuit from reaching the inner reservoir and finally the high pressure chamber, since this has a negative effect on the supply of oil to the inner reservoir and to the high pressure chamber and therefore on the adjustment of the play of the tappet when an internal combustion engine is restarted. There are already known hydraulic tappets substantially comprising a first outer part or body which engages the driving cam and has an outer annular reservoir where the oil collects, and a second inner part which slides telescopically inside the first one and is connected to the stem of a valve of the internal combustion engine, the inner reservoir and the high pressure chamber of variable capacity being provided by telescopic coupling of the first part inside the second one, said high pressure chamber communicating with the inner reservoir via a one way ball-valve.

As shown in U.S. Pat. No. 4,782,799 to Goppelt et al., it is known to provide within such a tappet a member which forces the oil to travel upward to the outer reservoir through a duct from an inlet port located in a low position relative to the outer reservoir, flow along a circular path through 180° to a second duct which carries the oil from a low level of the outer reservoir to the inner reservoir, thus providing a circuitous oil path which aids in deaerating the oil.

The present invention is an improvement to the above design wherein the tappet includes structure which causes the oil to traverse a 360° circular path and through two vertical levels in flowing from the inlet to the inner reservoir.

Initially, the oil flows along the upper level for 180° and then descends to a lower level, where it flows for another 180°. Hence it goes up a vertical channel to reach the inner reservoir. As air is lighter than oil, the air tends to stay in the upper part of the outer reservoir hence the oil in the lower area of the outer reservoir contains practically no air.

According to a first embodiment of the invention, there are provided two inserts forming a two-level outer reservoir and a guide for the telescopic parts of the tappet. Communication between the upper and lower levels of the inner annular reservoir is achieved via an opening provided between the two levels. The bottom of the lower level of the outer annular reservoir is formed by one of said inserts comprising a hub member including a web portion extending radially inwardly from the outer part or body of the tappet and an axially extending hub portion acting as a guide for the telescopically moving parts of the tappet.

According to another embodiment of the present invention, there is provided a single insert which forms the two-level outer reservoir, the hub member serving as a guide for the telescopic parts being provided by an axially-extending cylindrical extension of the end wall of the outer part.

Figure 2:
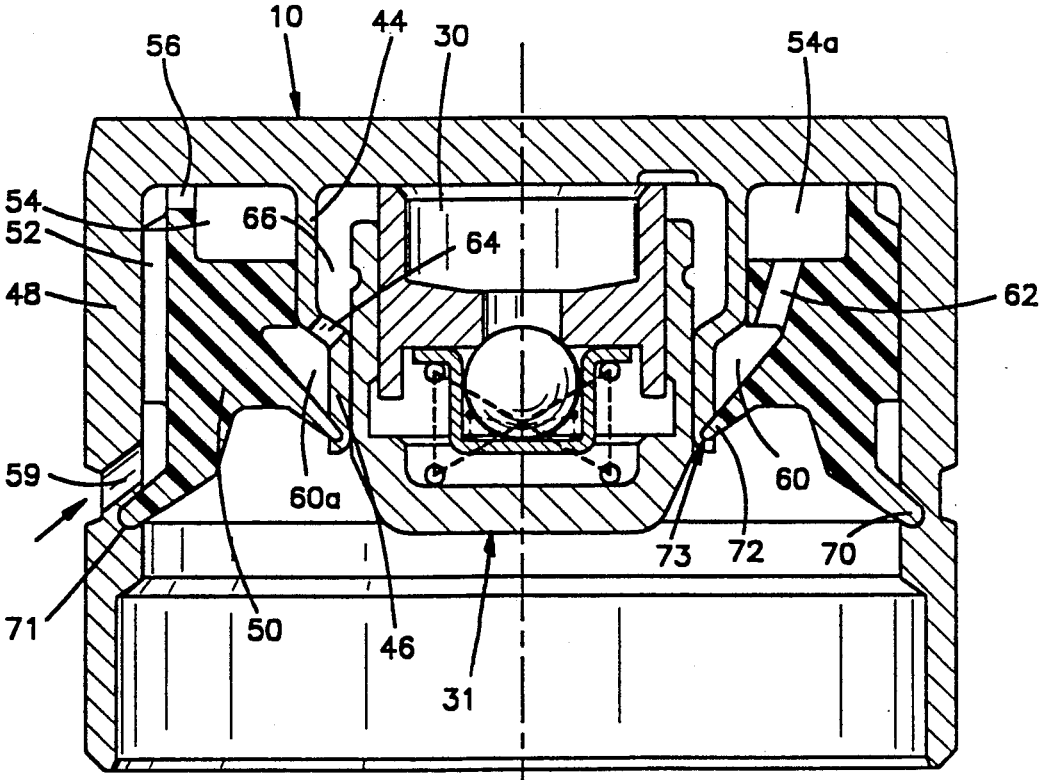

The present invention will now be described in detail, with reference to the attached drawings, wherein:

FIG. 1 shows a vertical cross-section of the outer part of the tappet, according to a first form of embodiment; and FIG. 2 shows a vertical cross-section of a second embodiment of the invention.

According to the first embodiment of the invention (see FIG. 1), the outer part 10 of the hydraulic tappet comprises a moulded or drawn cup-shaped member shaped as an upside-down bowl wherein there is inserted a first insert 12 preferably made of a plastic material and a second insert defining a hub member 14, preferably made of metal, which comprises an upper cylindrical hub portion 26 and a lower funnel-shaped web portion 28. The first insert 12, annular in shape and with a cross-section substantially in the shape of an "H", rests on the second insert, which is received in a circular seat 17 provided on the inner surface of a vertical wall 16 of the outer part 10 by means of a collar 15. The placement of insert 12 into the cavity of the outer part 10, provides an annular reservoir 18.

The oil coming from the lubrication circuit of the internal combustion engine fills the annular reservoir 18, formed by the insert 12 and the outer vertical wall 16, and then overflows, via a groove 19, into an outer upper reservoir 20, flowing along a circular path for 180° until it reaches an area **20*a* of the upper level or upper chamber of the outer reservoir. The oil then moves to a lower level or to a lower chamber 21 via an opening 22, flows along a circular path for another 180° and finally reaches an area 21*a*. The air bubbles which might have been present in the oil tend to stay in the upper part of the outer reservoir, namely in an upper area of the upper level 20—20*a* of the outer reservoir, given the lightness of air compared with oil. Subsequently, the oil passes through a channel defined by a vertical recess 24 formed in the annular insert 12 and fills the inner reservoir 30. The inner reservoir 30 is defined by the inside diameter of a piston 31*b*. The inner part 31 comprises a plunger 31*a* engageable with the valve stem, the piston 31*b* slidingly received within the plunger, and a check valve 31*c*. The web 28 of the second insert 14 forms the bottom of the lower level or lower chamber 21—21*a* of the outer reservoir. Since provision has been made for a two-level outer reservoir, the oil flowing from the upper to the lower level of the outer reservoir practically contains no air bubbles, because air is lighter than oil and therefore tends to stay in the upper area of the upper level 20—20*a*** of the outer reservoir.

A further advantage of this embodiment is the fact that the second insert 14 has a double function, acting both as a bottom for the lower level of the outer reservoir and as a guide for the telescopically moving parts.

According to the second embodiment of the invention, shown in FIG. 2, the outer part 10 of the hydraulic tappet comprises a cup-shaped part provided with an inner annular collar or hub member 44 which narrows at its free end 46. In the space provided between the outer wall 48 of the part 10 and the inner annular collar 44, 46 there is placed an insert 50 preferably made of plastic material. This insert 50 is shaped in such a way as to form, together with the arrangement of part 10, an overflow duct defined by a vertical channel 52 in the insert 50, an upper level or upper chamber **54—54*a* in the outer reservoir and a lower level or lower chamber 60—60*a* in the outer reservoir. The oil coming from the lubrication circuit of the internal combustion engine as shown by the arrow, enters the overflow duct 52 via an opening 59, and, having filled it, flows through an opening 56 provided in the upper part of the insert 50 into the outer reservoir, at a place corresponding to the upper level or upper chamber 54 of the outer reservoir. Subsequently, the oil flows along an annular path extending for 180° to reach an area 54***a* of the upper level or upper chamber 54 of the outer reservoir. From there, via a duct 62, it flows to the lower level or lower chamber 60 of the outer reservoir, and having flowed another 180° along a circular path, reaches an area 60*a* of the lower level or lower chamber 60 of the outer reservoir. Hence, via an opening 64 and a duct 66 defined by the annular space between inner part 31 and collar 44, it flows into the inner reservoir 30. In the second embodiment, the inner part 31 is guided by the inner cylindrical surface formed by wall 46.

An annular extension or rim 70 of the insert 50 is an interference fit in a seat 71 suitably provided on the inner surface of the wall 48 of part 42 and an extension or rim 72 is an interference fit in seat 73 formed in the wall 46.

This second embodiment of the invention offers the same advantages as the first embodiment, by using a single more complex insert which is fitted into the outer part 10.

I claim:

1. In a hydraulic tappet comprising a substantially cup-shaped outer part having an engine cam contacting surface formed thereon; a hub member received within and supported by said outer part; an inner part slidingly received within said hub member and having an engine valve contacting surface formed thereon, said outer part and said hub member defining an annular space between them; and an oil inlet formed in said outer part and opening into said annular space; the improvement comprising an annular insert received within said annular space, said insert in combination with said hub member, said inner part and said outer part defining an upper annular chamber, a lower annular chamber and an inner reservoir; first port means defining an oil flow path between said oil inlet and said upper annular chamber; second port means defining an oil flow path from said upper annular chamber to said lower annular chamber; and third port means defining an oil flow path from said lower annular chamber to said inner reservoir; said first and third port means being in substantial angular alignment with each other, and said second port means being displaced substantially 180° from said first and third port means.

2. A tappet as claimed in claim 1 in which said insert comprises a member substantially H-shaped in cross section, and said hub member comprises a web portion extending radially inwardly from the inner wall of said outer part and an axially extending tubular portion receiving said inner part, said web portion defining a lower boundary of said lower annular chamber.

3. A tappet as claimed in claim 2, in which an inner wall of said insert is in sealing engagement with said hub portion and said third port means comprises a channel formed in said inner wall defining a passage between said inner wall and said hub portion.

4. A tappet as claimed in claim 1, in which said hub member comprises a cylinder extending axially from the base portion of said outer part, and said insert comprises an annular member received between said hub and the interior wall of said outer part.

5. A tappet as claimed in claim 4 in which said insert includes an inwardly extending rim engaged with a recess formed in said hub member, and an outwardly extending rim engaged with a recess formed in said interior wall.

* * * * *